US007739822B1

(12) United States Patent
Holmberg

(10) Patent No.: US 7,739,822 B1
(45) Date of Patent: Jun. 22, 2010

(54) METHOD AND DEVICE FOR MOUNTING AN ACCESSORY TO A FIREARM

(76) Inventor: Larry Holmberg, 901 Cottonwood Dr., Harrisburg, SD (US) 57032

( * ) Notice: Subject to any disclaimer, the term of this patent is extended or adjusted under 35 U.S.C. 154(b) by 243 days.

(21) Appl. No.: 11/970,890

(22) Filed: Jan. 8, 2008

Related U.S. Application Data

(60) Provisional application No. 60/884,122, filed on Jan. 9, 2007.

(51) Int. Cl.
*F41A 15/00* (2006.01)

(52) U.S. Cl. ..... 42/90; 42/124; 42/125; 42/126; 42/127; 42/128; 124/86; 248/229.1

(58) Field of Classification Search ..... 42/124–128; 248/229.1; 124/86
See application file for complete search history.

(56) References Cited

U.S. PATENT DOCUMENTS

| | | | |
|---|---|---|---|
| 521,761 | A | 6/1894 | Day |
| 547,912 | A | 10/1895 | Crupe |
| 619,214 | A | 2/1899 | Paul |
| 674,229 | A | 5/1901 | Windle |
| 845,165 | A | 2/1907 | Davis |
| 899,639 | A | 9/1908 | Vibber |
| 1,452,651 | A | 4/1923 | Norrlin |
| 1,480,147 | A | 1/1924 | Fokko |
| 2,101,479 | A | 12/1937 | Schenk |
| 2,450,466 | A | 10/1948 | Carlson |
| 2,814,118 | A | 11/1957 | Evans et al. |
| 3,427,102 | A | 2/1969 | Wade |
| 3,483,623 | A | 12/1969 | Kruzell |
| 3,684,376 | A | 8/1972 | Lessard |
| 3,684,378 | A | 8/1972 | Lord |
| 3,737,232 | A | 6/1973 | Millburn, Jr. |
| 3,782,822 | A | 1/1974 | Spence |
| 3,785,261 | A | 1/1974 | Ganteaume |
| 3,834,052 | A | 9/1974 | Steck, III |
| 4,000,403 | A | 12/1976 | Rice |

(Continued)

FOREIGN PATENT DOCUMENTS

EP 1804017 A1 7/2007

(Continued)

OTHER PUBLICATIONS

Improved Construction Methods, "Laser Measuring System, Impulse LX", http://www.improvedconstructionmethods.com/impulse_xl.htm.

(Continued)

*Primary Examiner*—Troy Chambers
*Assistant Examiner*—Samir Abdosh
(74) *Attorney, Agent, or Firm*—Kinney & Lange, P.A.

(57) ABSTRACT

A device and method of using the device to attach an accessory to a firearm. The device is a longitudinally elongated, rigid, two-piece clamping coupling forming a longitudinally extending channel with a longitudinally extending seam and a longitudinally extending lateral gap in the coupling between the pieces. A set of longitudinally spaced clamping screws operably engaging both pieces of the coupling and extending laterally across the seam for laterally repositioning the pieces relative to one another to effect compressive clamping when rotated. A longitudinally extending receiving track is formed in at least one of the pieces.

13 Claims, 1 Drawing Sheet

U.S. PATENT DOCUMENTS

| | | | |
|---|---|---|---|
| 4,026,054 | A | 5/1977 | Snyder |
| 4,027,414 | A | 6/1977 | Felix |
| 4,069,414 | A | 1/1978 | Bell |
| 4,223,770 | A | 9/1980 | Kranz |
| 4,233,770 | A | 11/1980 | de Fillippis et al. |
| 4,283,743 | A | 8/1981 | Kaiser |
| T101,001 | I4 | 9/1981 | Shipp et al. |
| 4,296,725 | A | 10/1981 | Broderick |
| D268,910 | S | 5/1983 | Shipp et al. |
| 4,514,907 | A | 5/1985 | Saltzman |
| 4,516,296 | A | 5/1985 | Sherman |
| 4,531,052 | A | 7/1985 | Moore |
| 4,561,204 | A | 12/1985 | Binion |
| 4,564,322 | A | 1/1986 | Stapley |
| 4,597,211 | A | 7/1986 | Miles |
| 4,606,629 | A | 8/1986 | Hines et al. |
| 4,617,741 | A | 10/1986 | Bordeaux et al. |
| 4,640,258 | A | 2/1987 | Penney et al. |
| 4,643,159 | A | 2/1987 | Ryan |
| 4,730,190 | A | 3/1988 | Win et al. |
| 4,753,528 | A | 6/1988 | Hines et al. |
| 4,777,352 | A | 10/1988 | Moore |
| 4,786,204 | A | 11/1988 | Mayeda |
| 4,786,966 | A | 11/1988 | Hanson et al. |
| 4,827,348 | A | 5/1989 | Ernest et al. |
| 4,835,621 | A | 5/1989 | Black |
| 4,884,137 | A | 11/1989 | Hanson et al. |
| 4,890,128 | A | 12/1989 | Kania |
| 4,910,717 | A | 3/1990 | Terry |
| 4,939,863 | A | 7/1990 | Alexander et al. |
| 4,970,589 | A | 11/1990 | Hanson et al. |
| 4,974,575 | A | 12/1990 | Mitchell |
| D313,361 | S | 1/1991 | Robinson |
| 4,993,833 | A | 2/1991 | Lorey et al. |
| 4,996,866 | A | 3/1991 | Masera et al. |
| 5,005,213 | A | 4/1991 | Hanson et al. |
| 5,020,262 | A | 6/1991 | Pena |
| 5,026,158 | A | 6/1991 | Golubic |
| 5,033,219 | A | 7/1991 | Johnson et al. |
| 5,161,310 | A | 11/1992 | Stoot |
| 5,200,827 | A | 4/1993 | Hanson et al. |
| 5,262,837 | A | 11/1993 | Shyy |
| 5,265,896 | A | 11/1993 | Kravitz |
| 5,297,533 | A | 3/1994 | Cook |
| 5,326,061 | A | 7/1994 | Hamilton |
| 5,339,793 | A | 8/1994 | Findley |
| 5,373,657 | A | 12/1994 | Betz et al. |
| 5,418,609 | A | 5/1995 | Dunne |
| 5,455,625 | A | 10/1995 | Englander |
| 5,456,157 | A | 10/1995 | Lougheed et al. |
| 5,479,712 | A | 1/1996 | Hargrove et al. |
| 5,507,272 | A | 4/1996 | Scantlen |
| 5,520,164 | A | 5/1996 | Huddleston |
| D371,084 | S | 6/1996 | Ogawa |
| 5,531,149 | A | 7/1996 | Schubert et al. |
| 5,555,665 | A | 9/1996 | Fore |
| 5,575,072 | A | 11/1996 | Eldridge |
| 5,606,818 | A | 3/1997 | Hardee |
| 5,611,324 | A | 3/1997 | Kursinsky |
| 5,669,147 | A | 9/1997 | Nakajima et al. |
| 5,669,174 | A | 9/1997 | Teetzel |
| 5,686,690 | A | 11/1997 | Lougheed et al. |
| 5,687,910 | A | 11/1997 | King |
| 5,711,104 | A | 1/1998 | Schmitz |
| D390,483 | S | 2/1998 | Zykan et al. |
| 5,739,859 | A | 4/1998 | Hattori et al. |
| 5,815,251 | A | 9/1998 | Ehbets et al. |
| 5,822,621 | A | 10/1998 | Szajewski |
| 5,831,718 | A | 11/1998 | Desai et al. |
| 5,834,676 | A | 11/1998 | Elliott |
| 5,845,165 | A | 12/1998 | McMahan |
| 5,859,693 | A | 1/1999 | Dunne et al. |
| 5,887,375 | A | 3/1999 | Watson |
| 5,892,617 | A | 4/1999 | Wallace |
| 5,895,131 | A | 4/1999 | Yano |
| 5,911,215 | A | 6/1999 | Fisher, Jr. |
| 5,926,260 | A | 7/1999 | Dunne et al. |
| 5,937,562 | A | 8/1999 | Brough |
| 5,944,041 | A | 8/1999 | Kitchens |
| 5,949,529 | A | 9/1999 | Dunne et al. |
| 5,964,054 | A | 10/1999 | Galfidi, Jr. |
| 5,973,315 | A | 10/1999 | Saldana et al. |
| D421,229 | S | 2/2000 | Imai |
| 6,029,643 | A | 2/2000 | Golfieri |
| 6,070,355 | A | 6/2000 | Day |
| 6,073,352 | A | 6/2000 | Zykan et al. |
| D432,930 | S | 10/2000 | Sanoner |
| 6,137,564 | A | 10/2000 | Schmidt et al. |
| 6,154,971 | A | 12/2000 | Perkins |
| 6,192,614 | B1 | 2/2001 | Cliburn |
| 6,252,706 | B1 | 6/2001 | Kaladgew |
| 6,269,581 | B1 | 8/2001 | Groh |
| 6,286,796 | B1 | 9/2001 | Pugliesi |
| 6,288,386 | B1 | 9/2001 | Bowen et al. |
| 6,296,581 | B1 | 10/2001 | Sever |
| 6,304,289 | B1 | 10/2001 | Sakai et al. |
| 6,331,887 | B1 | 12/2001 | Shiraishi et al. |
| 6,336,285 | B1 | 1/2002 | Baumer |
| 6,341,201 | B1 | 1/2002 | Ishiguro et al. |
| 6,396,571 | B2 | 5/2002 | Ohtomo et al. |
| 6,397,483 | B1 | 6/2002 | Perkins |
| 6,398,571 | B1 | 6/2002 | Nishide et al. |
| 6,408,140 | B1 | 6/2002 | Malloy Desormeaux |
| D460,367 | S | 7/2002 | Apotheloz et al. |
| D460,368 | S | 7/2002 | Apotheloz et al. |
| D460,369 | S | 7/2002 | Apotheloz et al. |
| 6,425,697 | B1 | 7/2002 | Potts et al. |
| 6,450,816 | B1 | 9/2002 | Gerber |
| 6,487,809 | B1 | 12/2002 | Gaber |
| 6,494,196 | B2 | 12/2002 | Harwath et al. |
| 6,526,956 | B1 | 3/2003 | Hankins |
| D472,826 | S | 4/2003 | Sanoner |
| 6,556,245 | B1 | 4/2003 | Holmberg |
| 6,598,331 | B1 | 7/2003 | Thibodeaux |
| 6,615,531 | B1 | 9/2003 | Holmberg |
| 6,623,182 | B2 | 9/2003 | Tatera |
| 6,624,881 | B2 | 9/2003 | Waibel et al. |
| 6,678,988 | B1 | 1/2004 | Poff, Jr. |
| 6,681,755 | B2 | 1/2004 | Pujos |
| 6,693,702 | B2 | 2/2004 | Rogers |
| 6,704,097 | B2 | 3/2004 | Waibel et al. |
| D488,315 | S | 4/2004 | Natuzzi |
| 6,722,076 | B2 | 4/2004 | Nielsen |
| 6,742,299 | B2 | 6/2004 | Strand |
| 6,772,076 | B2 | 8/2004 | Yamamoto et al. |
| 6,784,920 | B2 | 8/2004 | Weber |
| 6,796,038 | B2 | 9/2004 | Humphries |
| 6,813,025 | B2 | 11/2004 | Edwards |
| 6,815,251 | B1 | 11/2004 | Akram et al. |
| 6,819,495 | B2 | 11/2004 | Shani et al. |
| 6,819,866 | B2 | 11/2004 | Da Silva |
| 6,886,287 | B1 | 5/2005 | Bell et al. |
| 6,886,288 | B1 * | 5/2005 | Yocum et al. ..... 42/127 |
| 6,932,305 | B2 * | 8/2005 | Morales et al. ..... 248/187.1 |
| 6,988,331 | B2 | 1/2006 | Holmberg |
| 7,006,144 | B2 | 2/2006 | Holmberg |
| 7,088,506 | B2 | 8/2006 | Regan et al. |
| 7,128,354 | B2 | 10/2006 | Wu |
| 7,269,920 | B2 | 9/2007 | Staley, III |
| 7,390,130 | B2 | 6/2008 | Soulvie |
| 2002/0067475 | A1 | 6/2002 | Waibel et al. |
| 2002/0078577 | A1 | 6/2002 | Aldred |
| 2002/0087475 | A1 | 7/2002 | Okayama et al. |
| 2002/0109057 | A1 * | 8/2002 | Wooten et al. ..... 248/229.1 |

| | | | |
|---|---|---|---|
| 2002/0171755 | A1 | 11/2002 | Nishimura |
| 2003/0013392 | A1 | 1/2003 | Guillermin |
| 2003/0133092 | A1 | 7/2003 | Rogers |
| 2003/0163943 | A1 | 9/2003 | Holmberg |
| 2004/0000083 | A1 | 1/2004 | Grant, Jr. |
| 2004/0016169 | A1 | 1/2004 | Poff, Jr. |
| 2004/0051865 | A1 | 3/2004 | Stierle et al. |
| 2004/0079018 | A1 | 4/2004 | Holmberg |
| 2004/0114129 | A1 | 6/2004 | Gogolla et al. |
| 2004/0135991 | A1 | 7/2004 | Gogolla et al. |
| 2004/0183942 | A1 | 9/2004 | Holmberg |
| 2004/0194364 | A1 | 10/2004 | Holmberg |
| 2004/0257437 | A1 | 12/2004 | Lesseu |
| 2005/0035245 | A1 | 2/2005 | Morales et al. |
| 2005/0123883 | A1 | 6/2005 | Kennen et al. |
| 2005/0195385 | A1 | 9/2005 | Holmberg |
| 2005/0241210 | A1 | 11/2005 | Karcher et al. |
| 2005/0246910 | A1 | 11/2005 | Mowers |
| 2005/0252062 | A1 | 11/2005 | Scrogin et al. |
| 2005/0268519 | A1 | 12/2005 | Pikielny |
| 2005/0268521 | A1 | 12/2005 | Cox et al. |
| 2006/0010761 | A1 | 1/2006 | Staley, III |
| 2006/0215149 | A1 | 9/2006 | LaBelle et al. |
| 2007/0008187 | A1 | 1/2007 | Schmidt |
| 2007/0031142 | A1 | 2/2007 | Moody et al. |
| 2007/0068018 | A1 | 3/2007 | Gilmore |
| 2007/0081817 | A1 | 4/2007 | Soulvie |
| 2007/0157502 | A1 | 7/2007 | Holmberg |
| 2007/0157503 | A1 | 7/2007 | Holmberg |
| 2007/0277421 | A1 | 12/2007 | Perkins et al. |
| 2008/0000465 | A1* | 1/2008 | Holmberg ..... 124/86 |
| 2008/0060248 | A1 | 3/2008 | Pine et al. |
| 2009/0255163 | A1* | 10/2009 | Holmberg ..... 42/124 |

FOREIGN PATENT DOCUMENTS

| | | | |
|---|---|---|---|
| GB | 2024558 | A | 1/1980 |
| GB | 2114770 | A | 8/1983 |
| WO | WO9012330 | | 10/1990 |
| WO | 2006090356 | A1 | 8/2006 |
| WO | WO2006090356 | A1 | 8/2006 |
| WO | 2006133029 | A2 | 12/2006 |
| WO | WO2006133029 | A2 | 12/2006 |

OTHER PUBLICATIONS

"Specification Sheet on the Impulse 200 LR Laser (Rangefinder)," Nov. 15, 2003, Publisher: Laser Technology Inc.

* cited by examiner

METHOD AND DEVICE FOR MOUNTING AN ACCESSORY TO A FIREARM

This application claims the benefit of U.S. Provisional Patent Application Ser. No. 60/884,122 filed on Jan. 9, 2007.

BACKGROUND

For game hunters the ability to record the hunt in an efficient manner is desired. Moreover, the ability to attach other devices such as cameras and other electronic devices to a weapon used in the hunt in a manner that does not impede the hunt is also desired. For the reasons stated above and for other reasons stated below which will become apparent to those skilled in the art upon reading and understanding the present specification, there is a need in the art for an attaching system that can attach a device such an electronic device to a weapon in an effective and un-intrusive manner.

For the reasons stated above and for other reasons stated below which will become apparent to those skilled in the art upon reading and understanding the present specification, there is a need in the art for an efficient and effective device mounting system for a weapon such as a shotgun.

SUMMARY OF THE INVENTION

A first aspect of the invention is a device for attaching an accessory to a firearm. The device is a longitudinally elongated, rigid, two-piece clamping coupling forming a longitudinally extending channel with a longitudinally extending seam and a longitudinally extending lateral gap in the coupling between the pieces. A set of longitudinally spaced clamping screws operably engaging both pieces of the coupling and extending laterally across the seam for laterally repositioning the pieces relative to one another to effect compressive clamping when rotated. A longitudinally extending receiving track is formed in at least one of the pieces.

A second aspect of the invention is a method of attaching an accessory to a firearm. The method includes the steps of (i) obtaining a firearm having a barrel, (ii) obtaining an accessory equipped with a mounting rail, (iii) obtaining an interconnection device, comprising at least (A) a longitudinally elongated, rigid, two-piece clamping coupling forming a longitudinally extending channel with a longitudinally extending seam and a longitudinally extending lateral gap in the coupling between the pieces, (B) a set of longitudinally spaced clamping screws operably engaging both pieces of the coupling and extending laterally across the seam for laterally repositioning the pieces relative to one another to effect compressive clamping when rotated, and (C) a longitudinally extending receiving track formed in at least one of the pieces, (iv) clamping the interconnection device onto the barrel of the firearm, and (v) sliding the mounting rail attached to the accessory into the receiving track on the interconnection device.

BRIEF DESCRIPTION OF THE DRAWINGS

In accordance with common practice, the various described features are not drawn to scale but are drawn to emphasize specific features relevant to the present invention. Reference characters denote like elements throughout Figures and text.

DETAILED DESCRIPTION OF THE INVENTION INCLUDING A BEST MODE

The present invention can be more easily understood and further advantages and uses thereof more readily apparent, when considered in view of the following detailed description and the previously references figures.

| Nomenclature | |
|---|---|
| A | Accessory |
| B | Barrel |
| F | Firearm |
| R | Rib |
| $R_{Connector}$ | Rib Connectors |
| 100 | Attaching Device |
| 102 | First Section of Attaching Device |
| 104 | Second Section of Attaching Device |
| 105 | First End of First Section of Attaching Device |
| 106 | Receiving Track in the First Section |
| 107 | Second End of First Section of Attaching Device |
| 108 | Apertures in the Second Section |
| 109 | Channel in the Attaching Device |
| 109a | Axis of Channel |
| 110 | Threaded Recesses in the First Section |
| 112 | Pins in the First Section |
| 114 | Attaching Aperture in the First Section |
| 121 | Seam |
| 122 | Gap |
| 130 | Barrel Sleeve |
| 200 | Device Mount Attaching System |
| 202 | Device Mount |
| 204 | Mounting Rail on the Device Mount |
| 206 | Threaded Members (Screws) |
| 210 | Thumbscrew |
| 212 | Support Plate |
| 214 | Side Plate |
| 216 | Stabilizing Tube |
| 300 | Device Mount Attaching System |
| 306 | Thumbscrew |
| x | Longitudinal Axis |
| y | Lateral Axis |
| z | Transverse Axis |

Construction

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention provide an attaching device that allows for the easy mount of a device mount to a weapon such as a shotgun. In embodiments of the present invention, a device coupled to the device mount is positioned directly under the barrel of the weapon.

Figure 1:
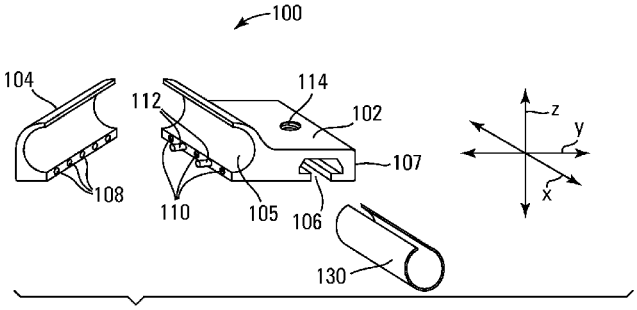
FIG. 1 is a side prospective view of a attaching device of one embodiment of the present invention.

Referring to FIG. 1 a side perspective view of an attaching device 100 of one embodiment of the present invention is illustrated. The attaching device 100 has a first section 102 and a second section 104. The first section 102 has a first end 105 and a second end 107. The first section 102 includes a receiving track 106 that is approximate the second end 107 and an attaching aperture 114 that extends from a surface (unnumbered) of the first section 102 to the receiving track 106. The first end 105 of the first section 102 is in generally a C-shape as illustrated in FIG. 1. In this embodiment, the second end 107 also includes a plurality of threaded recesses 110 and a plurality of extending pins 112. In one embodiment, the threaded recesses 110 and the extending pins 112 alternate in a row as illustrated in FIG. 1. The second section 104 of the attaching device is in generally a C-shape. The second section 104 has a plurality of apertures 108 that align with the row of threaded recesses 110 and extending pins 112 when the second section 104 is coupled to the first section 102. In one embodiment, threaded members 206 are used to attach the second section 104 to the first section 102. The threaded members 206 extend through select apertures 108 in the second section 104 and threadably engage respective threaded recesses 110 in the first section 102. The extending pins 112 guide the first and second sections 102 and 104 together so that apertures 108 and the respective threaded recesses 110 will be aligned for the threaded members 206. The extending pins 112 also prevent a twisting motion from occurring between the first and second sections 102 and 104 of the attaching device 100, when a respective threaded member 206 is tightened to attach the first section 102 to the second section 104.

The attaching device 100 preferrably has a longitudinal length of about 1 to 3 inches as a length of less than about 1 inch does not provide sufficient space for the recesses 110 and pins 112 and provides insufficient stability when clamped onto the barrel B of a firearm F, while a length of greater than about 3 inches adds unnecessary weight and bulk.

The longitudinal axis (unnumbered) of the receiving track 106 is preferably laterally y spaced about 1 to 3 inches from the longitudinal axis 109*a* of the channel 109 as a lateral y spacing of less than about 1 inch does not provide sufficient spacing to permit laterally y centering of an accessory A underneath the barrel B of a firearm F, while a length of greater than about 3 inches adds unnecessary weight and bulk.

Figure 2:
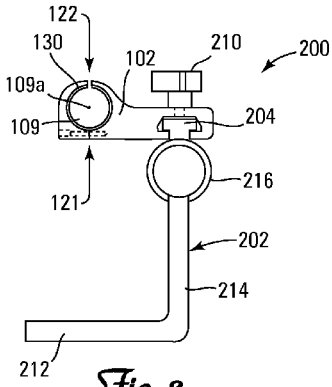
FIG. 2 is a side view of the attaching device of FIG. 1 coupled to a mounting device of one embodiment of the present invention.

As shown in FIG. 2, the lateral y gap 122 provided between the first and second sections 102 and 104 of the attaching device 104 along the longitudinal x length of the channel 109 is preferably sized to encompasses a sector of 10° to 30° relative to the longitudinal axis 109*a* of the channel 109 when the first and second sections 102 and 104 abut one another along the seam 121.

Figure 3:
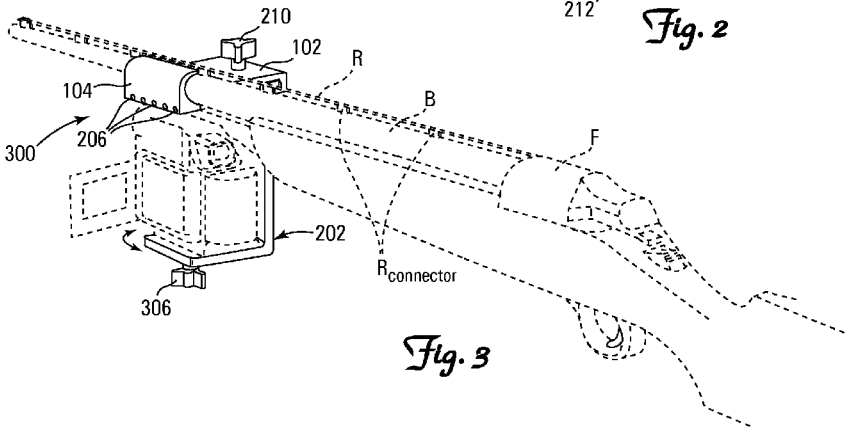
FIG. 3 is a side view of the attaching device mounting a device mount to a weapon.

A threaded member 206 is illustrated in the side view of FIG. 2. FIG. 2 illustrates a device mount attaching system 200. The threaded member 206 is placed through a respective aperture 108 and threadably engaged with a respective threaded recess 110. As illustrated, when the first section and the second section 102 and 104 are coupled together the respective C-shapes from a circle channel that can be positioned around a portion of a weapon such as shown in FIG. 3. Referring back to FIG. 2, the attaching device 100 is coupled to a device mount 202 via the receiving track 106. In particular, a rail 204 on the device mount 202 is received in the receiving track 106. The rail 204 on the device mount 202 is held in place in the receiving track 106 on the attaching device 100 via a thumb screw 210 that passes through aperture 114 on the attaching device 100. In one embodiment, the thumb screw 210 engages threads in aperture 114 and engages a surface (unnumbered) of the rail 204 to lock the rail 204 in place. In another embodiment, the thumbscrew 210 engages a threaded recess (not shown) in the rail 204 to lock the rail 204 in place. Device mount 202, illustrated in this embodiment, includes a support plate 212 upon which an accessory A is mounted, a side plate 214 and a stabilizing tube 216. As illustrated, the rail 204 extends from the stabilizing tube 216.

FIG. 3, illustrates a device mount attaching system 300 of one embodiment of the present invention. In particular, FIG. 3 illustrates an accessory A, such as a camera, coupled to a device mount 202 via thumb screw 306. The camera D can pivot about the thumbscrew 306 connection to center the camera D. As illustrated in FIG. 3, the first and second sections 102 and 104 of the attaching device 100 fit around the barrel B of a firearm F to attach the device mount 202 to the firearm F. Moreover, in the embodiment illustrated in FIG. 3, the firearm F is a shotgun with a ventilation rib R. As illustrated, in this embodiment, the first and second sections 102 and 104 are designed to fit under the rib R and between rib connectors $R_{Connector}$.

One feature of device mount system 300 of FIG. 3, is that the accessory A is positioned under the barrel B of the firearm F. Further in one embodiment, the weight of the device mount 202 is centered under the barrel B. Accordingly, the weight of the accessory A can be centered under the barrel B.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

Use

The attaching device 100 can be used to quickly attach an accessory A to a firearm F. The attaching device 100 is employed by simply, (1) obtaining a firearm F having a barrel B, (2) obtaining an accessory A either equipped with a mounting rail 204 or attached to a device mount 202 having a mounting rail 204, (3) clamping the attaching device 100 onto the barrel B of the firearm F as shown in FIG. 3, (4) sliding the mounting rail 204 on the accessory A into the receiving track 106 on the attaching device 100, and (5) tightening the thumbscrew 210.

I claim:

1. A device for attaching an accessory to a firearm, comprising:

(a) a longitudinally elongated, rigid, two-piece clamping coupling forming a longitudinally extending channel with a longitudinally extending seam and a longitudinally extending lateral gap in the coupling between the pieces, (b) a set of longitudinally spaced clamping screws operably engaging both pieces of the coupling and extending laterally across the seam for laterally repositioning the pieces relative to one another to effect compressive clamping when rotated, and (c) at least two guide pins extending laterally across the seam from one of the coupling pieces into fitted engagement within laterally extending corresponding bores in the other coupling piece, (d) wherein a longitudinally extending receiving track is formed in at least one of the pieces.

2. A device for attaching an accessory to a firearm, comprising:

(a) a longitudinally elongated, rigid, two-piece clamping coupling forming a longitudinally extending channel with a longitudinally extending seam and a longitudinally extending lateral gap in the coupling between the pieces, and (b) a set of longitudinally spaced clamping screws operably engaging both pieces of the coupling and extending laterally across the seam for laterally repositioning the pieces relative to one another to effect compressive clamping when rotated, (c) wherein a longitudinally extending receiving track is formed in at least one of the pieces, and (d) wherein the longitudinally extending lateral gap in the coupling between the pieces is configured and arranged for allowing passage of a rib on the barrel.

3. The device of claim 2 further comprising at least two guide pins extending laterally across the seam from one of the coupling pieces into fitted engagement within laterally extending corresponding bores in the other coupling piece.

4. The device of claim 1 wherein the device has a longitudinal length of 1 to 3 inches.

5. The device of claim 1 wherein the longitudinally extending lateral gap between the coupling pieces encompass a sector 10° to 30° relative to a longitudinal axis of the channel when the coupling pieces abut one another along the seam.

6. The device of claim 1 wherein the lateral gap and the receiving track open in opposite transverse directions.

7. The device of claim 1 wherein the receiving track is laterally spaced from the channel.

8. The device of claim 7 wherein the longitudinal axis of the receiving track is laterally spaced 1 to 3 inches from the longitudinal axis of the channel.

9. The device of claim 2 wherein the device has a longitudinal length of 1 to 3 inches.

10. The device of claim 2 wherein the longitudinally extending lateral gap between the coupling pieces encompass a sector 10° to 30° relative to a longitudinal axis of the channel when the coupling pieces abut one another along the seam.

11. The device of claim 2 wherein the lateral gap and the receiving track open in opposite transverse directions.

12. The device of claim 2 wherein the receiving track is laterally spaced from the channel.

13. The device of claim 12 wherein the longitudinal axis of the receiving track is laterally spaced 1 to 3 inches from the longitudinal axis of the channel.

* * * * *